US005440766A

United States Patent [19]

Schmidt

[11] Patent Number: 5,440,766

[45] Date of Patent: Aug. 15, 1995

[54] BATHTUB LIFTING APPARATUS

[75] Inventor: Peter Schmidt, Argenbühl/Eisenharz, Germany

[73] Assignee: Schmidt & Lenhardt GmbH & Co. oHG, Germany

[21] Appl. No.: 201,660

[22] Filed: Feb. 25, 1994

[30] Foreign Application Priority Data

May 11, 1993 [EP] European Pat. Off. ..... 93103902

[51] Int. Cl.[6] ..... A47K 3/12

[52] U.S. Cl. ..... 4/565.1

[58] Field of Search ..... 4/564.1, 565.1, 566.1, 4/560.1; 254/10 R, 10 B, 10 C

[56] References Cited

U.S. PATENT DOCUMENTS 4,557,002 12/1985 Schmidt ..... 4/564.1

4,660,234 4/1987 Schmidt ..... 4/566.1

5,007,121 4/1991 McEathron ..... 4/566.1

*Primary Examiner*—Charles E. Phillips

*Attorney, Agent, or Firm*—Notaro & Michalos

[57] ABSTRACT

A U-shaped outer frame (18) and a rectangular inner frame (14) form the guide framework for the lift platform (24) of a lifting apparatus. The two frames (14, 18) are each made integrally of glass-fibre-reinforced plastic and have sliding articulations (20), which are moulded on integrally and are guided by runners. The sliding articulations (20) are formed on hook-like extensions (38) of the longitudinal shanks (28, 32) of the frames (14, 18), and when the lift platform (24) is in its lowered position, the sliding articulations (20) are substantially below the outlines of the outer frame (18) and above the outlines of the inner frame (14).

10 Claims, 4 Drawing Sheets

BATHTUB LIFTING APPARATUS

BACKGROUND OF THE INVENTION

The invention relates to a lifting apparatus for handicapped persons, useful for insertion in a bathtub, comprising a bottom plate, a guide device consisting of two frames joined together in a scissors-like, articulated manner, a lift platform guided by said guide device, and a lifting device for raising and lowering the lift platform, the two frames each having two parallel longitudinal shanks and at least one transverse shank, and each frame having two coaxial non-sliding articulations on one of the plates and two coaxial sliding articulations, guided in C-profile sections for example, on the other plate.

PRIOR ART

A lifting apparatus of a similar kind is known from EP-A-0131741. The sliding articulations are formed by rollers, which run in U-shaped runners open at the side. The rollers of the outer frame are disposed laterally outside the frame, and the rollers of the inner frame rest on the insides of the longitudinal shanks. All the shanks of the two frames consist of rectangular sections made of rust-proof steel. The longitudinal shanks need to be welded or flanged to the transverse shanks. In addition, holes must be drilled, the articulated rollers have to be mounted on axles, and the axles must be fitted to the longitudinal shanks of the frame. Quite apart from the considerable amount of assembly work involved, there are also a number of shortcomings inherent in the known lifting apparatus. The rollers require runners which are relatively high and limit the depth to which the lift platform can be lowered, since the transverse shanks come to rest on these runners. In the lowest possible position of the lift platform, the longitudinal shanks of the two frames are still inclined at a certain angle. Because of the design, it is therefore not possible to lower the lift platform any further.

SUMMARY OF THE INVENTION

The object of the invention is to further simplify the lifting apparatus of the type described at the beginning, to provide greater stability, and to further reduce the distance of the lift platform from the floor when it is in its lowest position.

This problem is solved in a lifting device of the type described at the beginning in that, when the lift platform is in its lowest position, the two frames are engaged in such a way that one frame forms an inner frame, which occupies part of the internal space formed by the two defining planes of the outer frame; that the central vertical plane of each longitudinal shank of both frames coincides with that of a runner; that the open side of the runners faces away from the respective plate; that the articulated axles of the sliding articulations are spaced apart from the central longitudinal axis of the longitudinal shanks and offset towards the respective runners; that each articulation is made up of two pegs protruding in each case from opposing lateral surfaces of each longitudinal shank; and that the pegs are disposed immovably on the respective longitudinal shank. Major embodiments of the invention consist in the fact that each longitudinal shank, together with its peg, is an integral moulded plastic part; that each longitudinal shank has a hook-like extension on the side of the sliding articulation, which thus extends substantially at right angles to the longitudinal direction of the longitudinal shank. Said extension, which has the two pegs disposed upon it, extends directly at the end of the longitudinal shank. The axial displacement of the pegs from the centres of the shanks is so great that, when seen from the side, the shanks are for the greater part located outside the contours of the longitudinal shanks. Preferably, the hook-like extension with the two lateral pegs has a dimension, measured transversely to the longitudinal direction of the longitudinal shanks, approximately equal to the diameter of the peg as measured in that direction. According to the invention, the runner has a low, flat C-profiled with the width of the opening being slightly greater than the breadth of the longitudinal shanks, so that the latter descend into runners slightly when the lift platform is in its lowest position.

A particularly advantageous further feature of the invention consists in the fact that each of the two frames is an integral moulded plastic part, the longitudinal and transverse shanks each being made of solid, fibre-reinforced plastic. Each of the two frames is produced by injection moulding in a separate mould. This results in rounded edges, and likewise the bore holes for the fixed bearings and the central cross-bar can be moulded in at the same time, so that there is no need for any finishing work.

DETAILED DESCRIPTION

Figure 1:
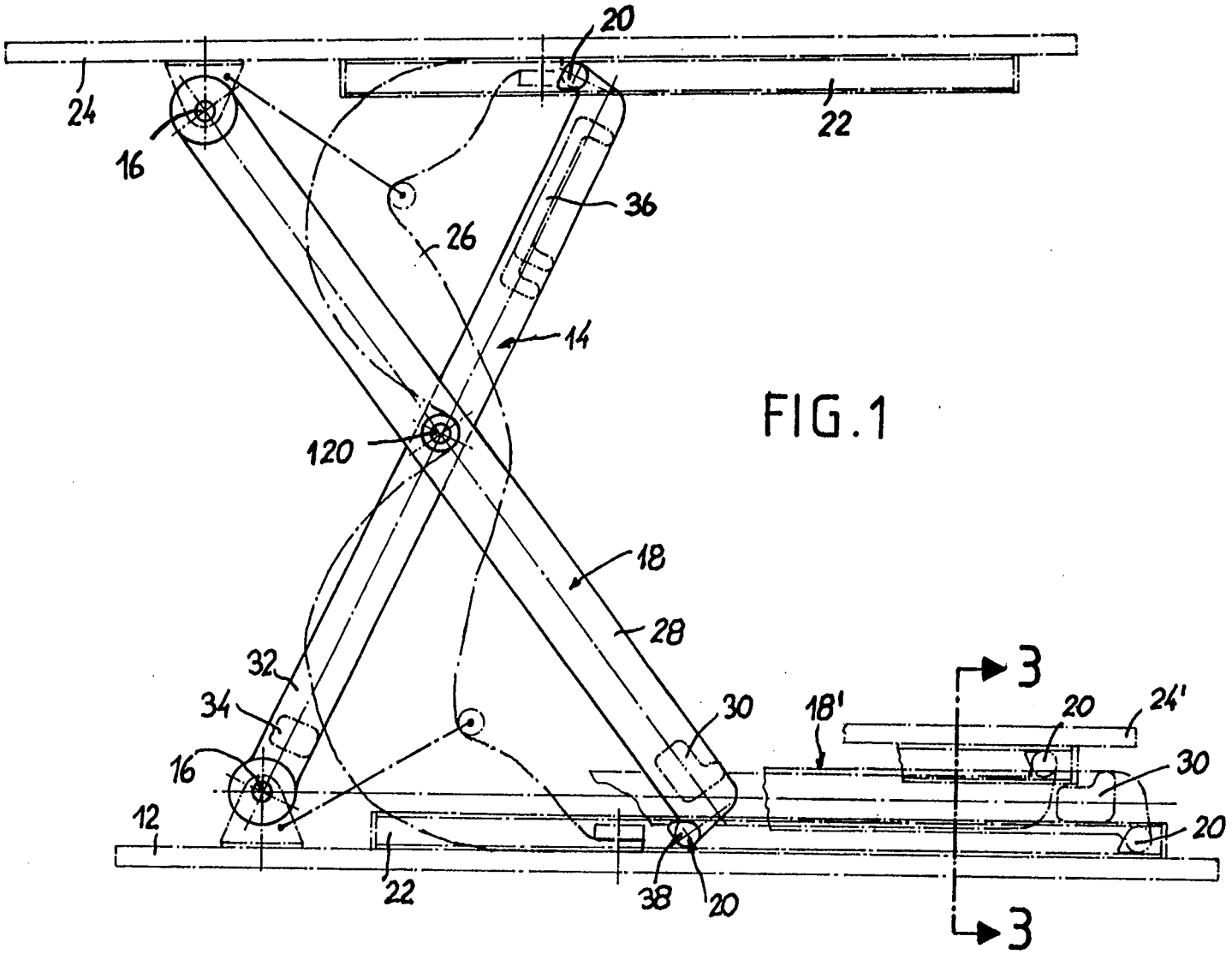
FIG. 1 is a side view of the lifting apparatus, with the raised position of the lift platform shown in solid lines and the lowered position of the end on the right-hand side shown in dot-dash lines.

An inner frame 14 is mounted on a bottom plate 12 so as to be pivotable about two stationary articulations 16 arranged in a transverse direction. At its lower end, an outer frame 18 has two sliding articulations 20, which are guided in runners 122. The two frames 14, 18 are articulatedly connected in their central portion by means of a transverse rod 120. The upper end of the inner frame 14 has a pair of sliding articulations 120 corresponding to those on the lower end of the outer frame, which are movably guided in runners 22 on the underside of a lift platform 24. On the upper end of the outer frame 18, there are two fixed articulations 16, corresponding to those on the lower end of the inner frame and mounted in brackets on the underside of the lift platform 24. A flexible pressure hose 26 between the bottom plate 12 and the lift platform 24 serves to raise and lower the lift platform.

In the lowered position 24' of the lift platform 24, the two frames 14, 18 are parallel in their respective positions 14' and 18' and parallel to the bottom plate 12, in which position the inner frame slips completely into the contours of the outer frame 18, with the exception of its sliding articulations 20. The part of the outer frame 18 extending downwards from the articulated rod 120 is somewhat longer than that of the inner frame 14. In this overhanging part of the outer frame 18, said outer frame 18 has a transverse shank 30 integrally connecting its longitudinal shanks 28. At the opposite end, there is no transverse shank, so that the outer frame is shaped like an open 'U'. The inner frame 14 consists of two longitudinal shanks 32, one lower transverse shank 34 and one upper transverse shank 36 in the form of a broad ribbed reinforcing plate. The inner frame 14 is thus closed about its periphery.

The runners 22 are composed of flat profile sections, the open sides of which face away from the respective plates 12 and 24. The width of the opening of the C-runners is slightly greater than the thickness, measured in the transverse direction of the lifting apparatus, of the two longitudinal Shanks 28 of the outer frame 18 or the longitudinal shanks 32 of the inner frame 14. The two shanks 28, 32 engage in the runners 22 slightly. The shanks 28, 32 lie in the centre of the longitudinal direction of the runners 22.

The two frames 14, 18 consist of integrally moulded, glass-fibre-reinforced plastic parts, and the sliding articulations 20 are moulded on at the same time. They consist of a hook-like extension 38 disposed on the extreme end of the respective longitudinal shank 28 or 32 and extending approximately at right angles to the longitudinal direction; two pegs 40, each projecting laterally over the side faces of the longitudinal shanks 28, 32, are provided on said extension 38. In their outlines, said pegs 40 have two flat supporting surfaces 42, 44 diverging at an angle of about 50° and running into a regular cylindrical surface 46 with a constant transition, said surface 46 linking the two supporting surfaces 42, 44 and extending over a circumferential angle of about 230°. The pegs 40 thus have approximately the shape of an elongate drop. The 50° angle of divergence corresponds to the angle through which the frames 14, 18 swivel between their lowered position and their raised position. The supporting surfaces 44 of the pegs 40 facing away from the frame extend parallel to the longitudinal direction of the frames 14, 18. In the lowered positions 14', 18' of the two frames, said frames each rest with their supporting surfaces 44 on the bottom shanks of the runners 22 on the bottom plate 12 and the lift platform 24. In the raised position of the lift platform 24, the two other supporting surfaces 42, facing the frame, come into play and rest flat on the C-shanks of the runners 22, which are facing one another, because the lifting hose 26 presses the two plates 12, 24 apart. In the two end positions, the flat supporting surfaces 42, 44 of the pegs 40 avoid touching lines and ensure lower surface pressure. The diameter of the regular cylindrical surface 46 linking the two flat supporting surfaces 42, 44 corresponds to the overhead clearance of the runner 22, while the outer breadth of the extension 38 with the two pegs 40 corresponds approximately to the inner width of the runner 22. Between the two pegs 40 of each extension 38, a recess 48 is formed in the central portion, extending along the two supporting surfaces 42, 44 and along a certain circumferential angle, adjoining said surfaces in each case, and continuing into the cylindrical surface 46. Said recess 48 can take the form of a circumferential groove and serves to receive the heads of rivets with which the runners 22 are fixed to the plates 12, 24.

Figure 2:
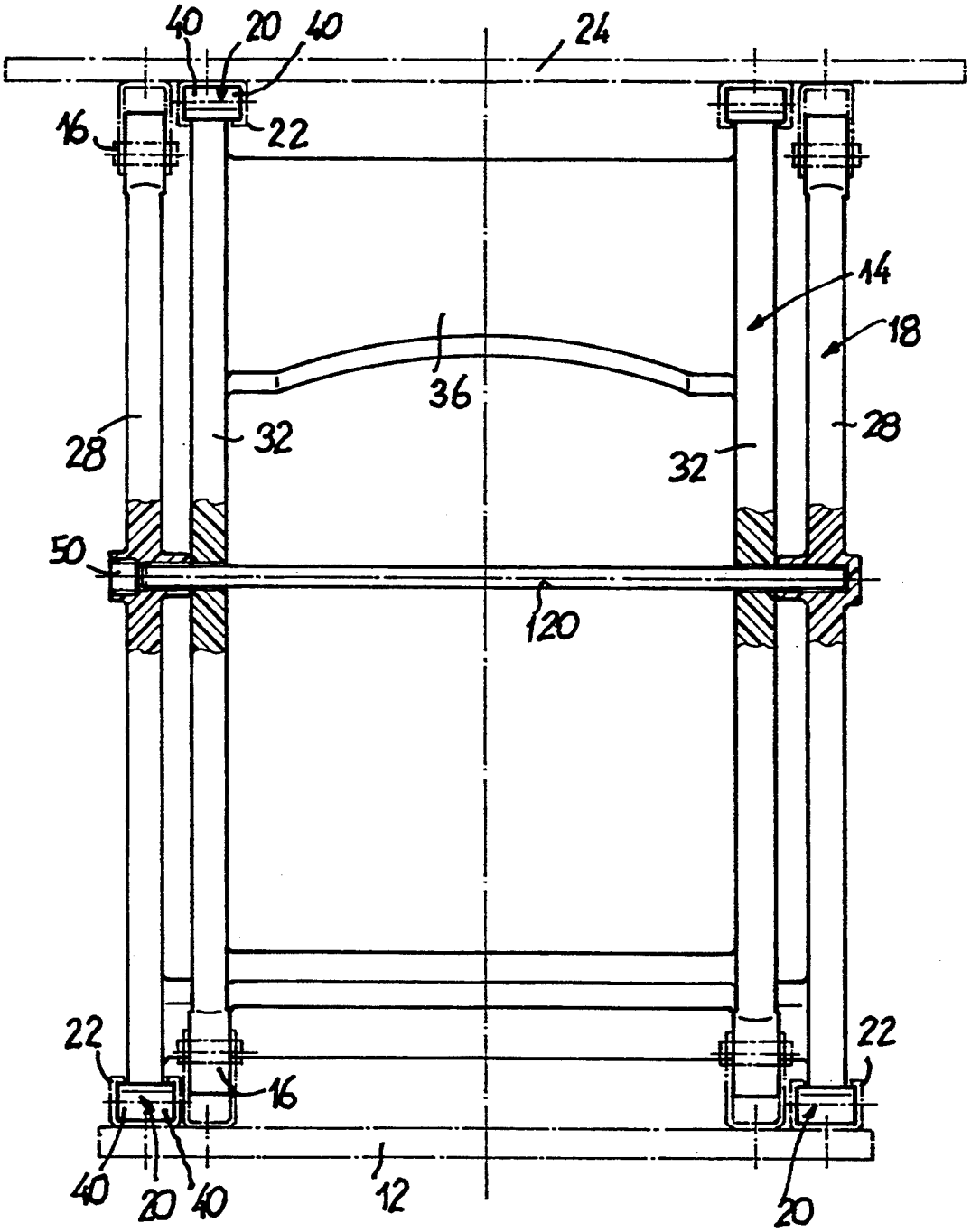
FIG. 2 is a frontal view of the lifting apparatus in the raised position.
Figure 3:
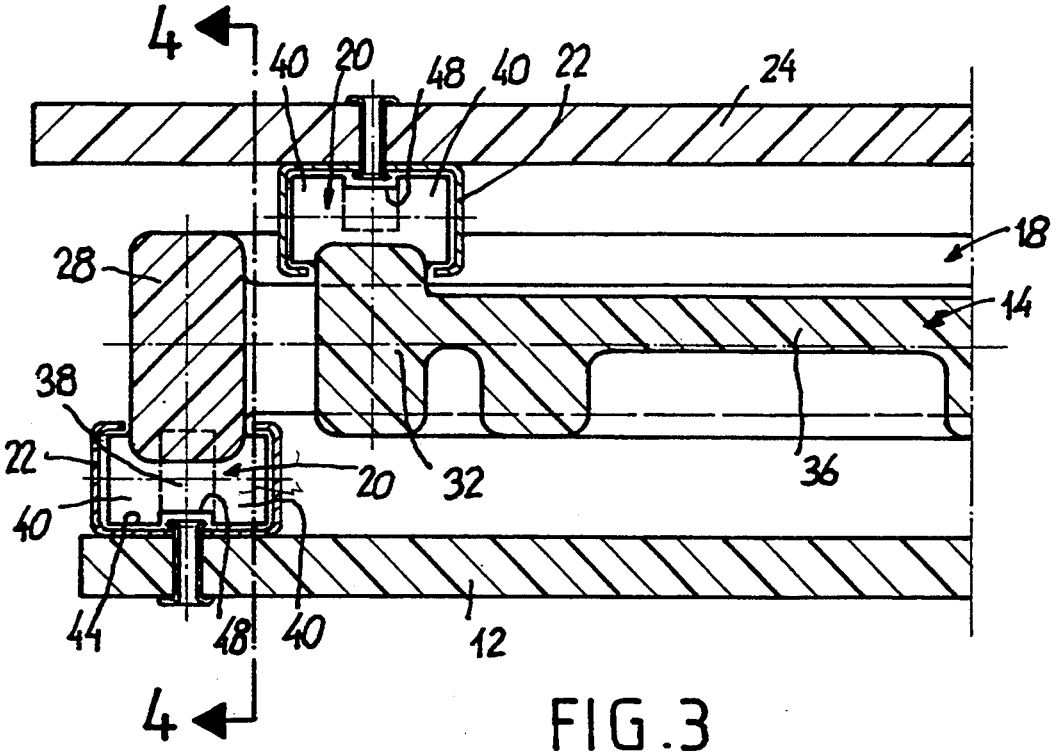
FIG. 3 is a sectional view approximately along the line 3—3 in FIG. 1.
Figure 4:
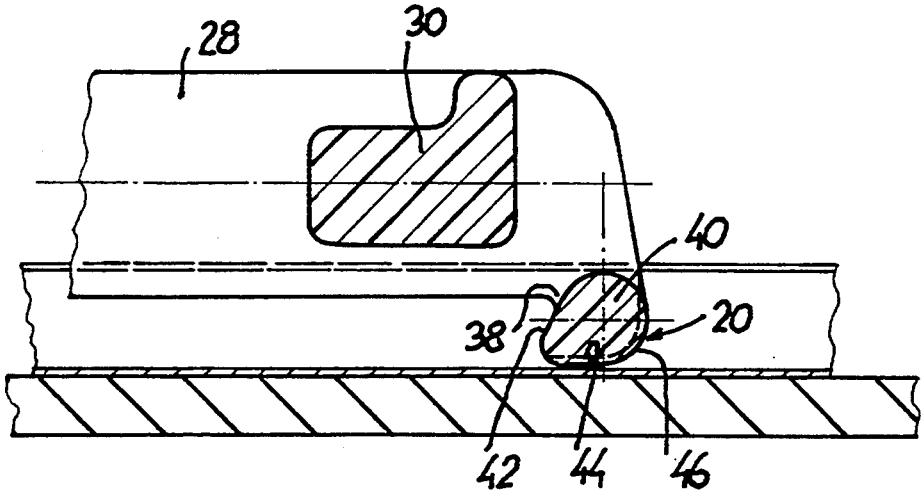
FIG. 4 is a sectional view along the line 4—4 in FIG. 3.
Figure 5:
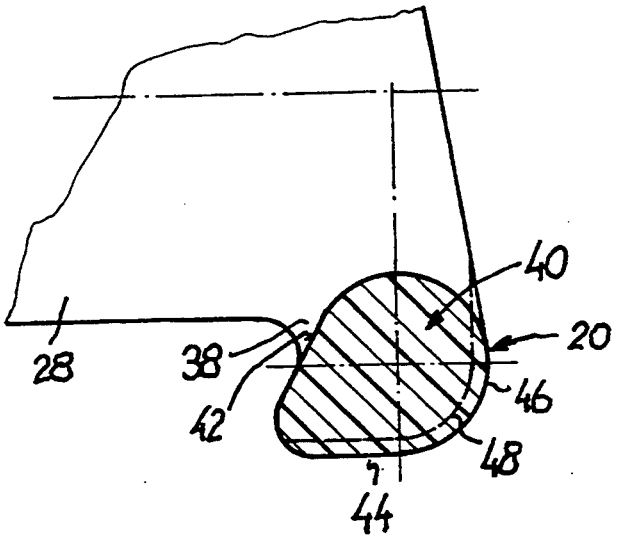
FIG. 5 is a detail from FIG. 4 on a larger scale.

As can be seen from FIG. 2, the two longitudinal shanks 32 of the inner frame 14 have coaxially aligned bore holes in the central portion which, when the lifting apparatus is in its assembled state, form a blind hole in one longitudinal shank 28 of the outer frame 18 and a stepped via hole in the opposite longitudinal shank 28 of said outer frame 18. The unthreaded transverse rod 120 is inserted through said via hole until it abuts in said blind hole. The transverse rod 120 is shorter than the outer width of the outer frame 18. A plug 50 is inserted into a threaded portion of the stepped hole.

I claim:

1. Lifting apparatus for handicapped persons, for insertion in a bathtub, comprising a bottom plate (12), a guide device consisting of two frames (14, 18) joined together in a scissors-like, articulated manner, a lift platform (24) guided by said guide device, and a lifting device (26) for raising and lowering the lift platform (24), the two frames (14, 18) each having two parallel longitudinal shanks (28, 32) and at least one transverse shank (30, 34, 36), each longitudinal shank (28, 32) lying in a separate vertical plane, and each frame (14, 18) having two coaxial non-sliding articulations (16) on one of the plate and platform (12, 24), and two runner-guided sliding articulations (20), coaxial in each case, on the other of the plate and platform (12, 24), the two frames (14, 18), when the lift platform (24) is in its lowest position, being engaged in such a way that one of the two frames (14) forms an inner frame which occupies part of an internal space between the vertical planes of the shanks of the other of the two frames (18), the other of the two frames constituting an outer frame (18), the two runner-guided sliding articulations each comprising a runner (22) for each of the longitudinal shanks, each runner connected to one of the plate and platform (12, 24) and extending in the vertical plane of its respective longitudinal shank, each runner having an open side facing away from the one of the plate and platform (12, 24) to which the runner is connected, each sliding articulation (20) having an articulated axis about which the frame of that sliding articulation slides and rotates, each longitudinal shank having a central longitudinal axis, the articulated axis of each sliding articulation being spaced apart from the central longitudinal axis of each longitudinal shank in a direction toward a respective runner to which the sliding articulation is engaged, each sliding articulation having two pegs (40) protruding in each case on opposite lateral surfaces of each longitudinal shank (28, 32), the pegs (40) being disposed immovably on the respective longitudinal shank (28, 32) and sliding and rotating in one of the runners.

2. Lifting apparatus as claimed in claim 1, wherein each longitudinal shank (28, 32), together with its peg (40), is an integral moulded plastic part.

3. Lifting apparatus as claimed in claim 1, wherein each longitudinal shank (28, 32) has a hook-like extension (38) on the side of the sliding articulation, which has the two pegs (40) disposed upon it.

4. Lifting apparatus as claimed in claim 1, wherein each of the two frames (14, 18) is an integral moulded plastic part.

5. Lifting apparatus as claimed in claim 4, wherein the longitudinal and transverse shanks (28, 32; 30, 34, 36) of each frame (14, 18) are made of solid, fiber-reinforced plastic.

6. Lifting apparatus as claimed in claim 1, wherein the two frames are joined by an articulated rod which passes through and links the two frames (14, 18) centrally and is unthreaded, the length of the rod being less than the outer width of the outer frame (18), and the articulated rod abuts at one end against a plug (50) inserted in the longitudinal shank (28) of the outer frame (18).

7. Lifting apparatus as claimed in claim 1, wherein the pegs (40) are not circular in shape and have at least one at least approximately flat supporting surface (42, 44), which is located in one of the two final raising positions of the lift platform (24), parallel to the runners (22) guiding them.

8. Lifting apparatus as claimed in claim 7, wherein the cross-section of each peg (40) has two flat supporting surfaces (42, 44), which diverge at an angle in the range of 40° to 60°, and whose diverging ends are joined together by a regular cylindrical surface (46) with a constant transition and extending over a circumferential angle of more than 225°.

9. Lifting apparatus as claimed in claim 1, wherein a recess (48) is provided in the section between the two pegs (40) of one end of a longitudinal shank and extends along at least a part of the circumference of the peg.

10. Lifting apparatus as claimed in claim 1, wherein the transverse shank (36) of the inner frame (14) on the side of the sliding articulation is in the form of a reinforcing plate with a broad surface.

* * * * *